United States Patent [19]

Stewart et al.

[11] Patent Number: 4,957,612

[45] Date of Patent: Sep. 18, 1990

[54] ELECTRODES FOR USE IN ELECTROCHEMICAL PROCESSES

[75] Inventors: Ray F. Stewart, Redwood City; James C. Thompson, Los Altos, both of Calif.

[73] Assignee: Raychem Corporation, Menlo Park, Calif.

[21] Appl. No.: 12,394

[22] Filed: Feb. 9, 1987

[51] Int. Cl.[5] ..... C23F 13/16

[52] U.S. Cl. ..... 204/196; 204/147; 204/290 F

[58] Field of Search ..... 204/147, 196, 290 F, 204/294

[56] References Cited

U.S. PATENT DOCUMENTS

| | | | |
|---|---|---|---|
| 2,053,214 | 9/1936 | Brown | 204/1 |
| 2,491,225 | 12/1949 | Stearnso | 204/147 |
| 3,022,242 | 2/1962 | Anderson | 204/196 |
| 3,151,050 | 9/1964 | Wilburn | 204/147 |
| 3,260,661 | 7/1966 | Kemp et al. | 204/197 |
| 3,354,063 | 10/1967 | Shutt | 204/148 |
| 3,391,072 | 7/1968 | Pearson | 204/197 |
| 3,498,898 | 3/1970 | Bogart et al. | 204/181.1 |
| 3,798,142 | 3/1974 | Evans | 204/147 |
| 3,868,313 | 2/1975 | Gay | 204/196 |
| 4,196,064 | 4/1980 | Harms et al. | 204/147 |
| 4,255,241 | 3/1981 | Kroon et al. | 204/147 |
| 4,267,029 | 5/1981 | Massarsky | 204/196 |
| 4,473,450 | 9/1984 | Nayak et al. | 204/196 |
| 4,487,676 | 12/1984 | Parker et al. | 204/196 |
| 4,502,929 | 3/1985 | Stewart et al. | 204/147 |

FOREIGN PATENT DOCUMENTS

| | | |
|---|---|---|
| 085237 | 8/1983 | European Pat. Off. . |
| 147977 | 7/1985 | European Pat. Off. . |
| 34293 | 10/1973 | Japan . |
| 48948 | 5/1978 | Japan . |
| 59-190373 | 10/1984 | Japan . |
| 8602106 | 4/1986 | PCT Int'l Appl. . |
| 1394292 | 5/1975 | United Kingdom . |
| 2046789 | 11/1980 | United Kingdom . |

*Primary Examiner*—John F. Niebling
*Assistant Examiner*—Steven P. Marquis
*Attorney, Agent, or Firm*—Timothy H. P. Richardson; Herbert G. Burkard

[57] ABSTRACT

Electrodes for electrochemical processes, especially anodes for the cathodic protection of metal substrates, e.g. reinforcing bars in concrete, comprise a conductive core which acts as a current-distributing member, an outer member which provides an electrochemically active outer surface, and an intermediate member composed of a material which is of higher resistivity, and/or which is less electrochemically active, than the material of the outer member. The higher the resistivity of the intermediate member, the more regular the current distribution along the length of the electrode. When the intermediate member is less electrochemically active, this protects the core from corrosion if the outer member is damaged by physical means or through electrochemical erosion. Preferably at least one of the intermediate member and the outer member is composed of a conductive polymer, especially one comprising carbon black or graphite as conductive filler.

16 Claims, 2 Drawing Sheets

ELECTRODES FOR USE IN ELECTROCHEMICAL PROCESSES

FIELD OF THE INVENTION

This invention relates to electrodes for use in electrochemical processes.

INTRODUCTION TO THE INVENTION

It is well known to carry out electrochemical reactions by maintaining a potential difference between two electrodes which are exposed to and electrically connected by at least one electrolyte. A particularly important electrochemical reaction is the prevention of corrosion of a substrate by maintaining a potential difference between the substrate and an electrode so that current passes between the electrode and the substrate. In such methods, the substrate is usually the cathode. Suitable anodes include discrete anodes (for example anodes comprising a metallic core surrounded by graphite, a mixture of graphite and carbon, or a dispersion of graphite or carbon black in a thermoset resin) and distributed anodes (for example conductive paints, and platinum or platinum-coated wires). For further details of anodes which have been used, or proposed for use, reference may be made for example to U.S. Pat. Nos. 4,319,854 (Marzocchi), 4,267,029 (Massarsky), 4,255,241 (Kroon et al), 4,196,064 (Harms et al), 3,868,313, (Gay), 3,798,142 (Evans), 3,391,072 (Pearson), 3,354,063 (Shutt), 3,151,050 (Wilburn), 3,022,242 (Pearson) and 2,053,214 (Brown), UK Pat. Nos. 1,394,292 and 2,046,789A and Japanese Patent Publications Nos. 34293 (1973) and 48948 (1978). The disclosure of each of these patents and publications is incorporated herein by reference. In recent years, increasing attention has been directed to distributed anodes having an electrochemically active surface which comprises a conductive polymer, this term being used to denote a composition which comprises a polymer component and, dispersed in the polymer component, a particulate conductive filler which has good resistance to corrosion, especially carbon black or graphite. Thus U.S. Pat. No. 4,502,929 (Stewart et al), the disclosure of which is incorporated herein by reference, describes distributed anodes whose electrochemically active surface is provided at least in part by an element which is composed of a conductive polymer and which is preferably at least 500 microns thick. Preferred electrodes are flexible and comprise a metal core and an element which surrounds the core and is composed of a conductive polymer which has a resistivity of 0.1 to 1000 ohm.cm and an elongation of at least 10%. U.S. Pat. No. 4,473,450 (Nayak et al), the disclosure of which is incorporated herein by reference, notes that failure of the anodes described in U.S. Pat. No. 4,502,929 takes place when degradation of the conductive polymer permits ingress of the electrolyte to the metal core, and discloses that the rate of ingress can be reduced by means of second elements which are partially embedded in and project from the conductive polymer element and which are composed of a material such that the electrochemical reaction takes place preferentially on the projecting surfaces of the second elements. In U.S. Pat. No. 4,473,450, it is theorized that the improved properties of such anodes result at least in part from the ability of damaging electrochemical reaction products to escape more easily if they are generated on the protruding portions of the second elements than they can if they are generated within the mass of conductive polymer. Copending, commonly assigned application Ser. No. 684,885 (Z021), the disclosure of which is incorporated herein by reference, discloses an anode which is particularly suitable for use in the cathodic protection of reinforcing bars in concrete, and which comprises a plurality of elongate strands which are joined together to form a flexible open mesh, at least some of the strands being electrically conductive and comprising carbonaceous material. Copending, commonly assigned application Ser. No. 650,921 (MPO973), the disclosure of which is incorporated herein by reference, discloses a preferred method of making an elongate electrode by pressure-extruding a conductive polymer around a metal conductor while drawing a vacuum on the conductor.

SUMMARY OF THE INVENTION

We have discovered that in electrodes comprising (i) a conductive core which is composed of a first conductive material having a first resistivity at 23° C. and which acts as a current-distributing member and (ii) an outer element which provides an electrochemically active surface, improved current distribution is obtained if the conductive core is electrically surrounded by an intermediate element which is composed of a second conductive material having a second resistivity at 23° C. which is higher than the first resistivity, the intermediate element preferably having a transverse resistance which is at least 1 ohm.meter. The higher the transverse resistance of the intermediate element, the more uniform the current distribution. We have further discovered that in electrodes comprising (i) a conductive core which acts as a current-carrying member and (ii) an outer element which provides an electrochemically active surface, the useful life of the electrodes is substantially increased by the presence of an intermediate element which electrically surrounds the core and which is composed of a material which is less electrochemically active than the outer element. The advantages of the latter discovery are particularly apparent when the current density on the anode varies substantially along its length, thus causing erosion to be concentrated at small sections of the anode.

In one aspect, the present invention provides an article which is suitable for use as an electrode in an electrochemical process and which comprises (a) a core which (i) is composed of a first conductive material having a first resistivity at 23° C., and (ii) does not provide any part of the electrochemically active surface of the electrode;

(b) an intermediate element which (i) is secured to and electrically surrounds the core, (ii) is composed of a second conductive material having a second resistivity at 23° C., the second resistivity being higher than the first resistivity, (iii) provides at most part of the electrochemically active surface of the electrode; and (iv) preferably has a transverse resistance of at least 1 ohm.meter; and (c) an outer element which (i) is secured to and is in electrical contact with the core and the intermediate element so that all electrical paths between the core and the outer element pass through the intermediate element, (ii) is composed of a third conductive material having a third resistivity at 23° C., and (iii) provides at least part of the electrochemically active surface of the electrode;

subject to the proviso that if there are a plurality of outer elements which are partially embedded in and project from the surface of the intermediate element and which are composed of a third material which is more electrochemically active than the second material, the second resistivity is at least 1,200 ohm.cm.

In another aspect, the present invention provides an article which is suitable for use as an electrode in an electrochemical process and which comprises (a) a core which is composed of a first conductive material having a first resistivity at 23° C. and which does not provide any part of the electrochemically active surface of the electrode;

(b) an intermediate element which (i) is secured to and electrically surrounds the core, (ii) is composed of a second conductive material having a second resistivity at 23° C., and (iii) provides at most part of the electrochemically active surface of the electrode; and (c) an outer element which (i) is secured to and is in electrical contact with the core and the intermediate element so that all electrical paths between the core and the outer element pass through the intermediate element, (ii) is composed of a third conductive material which is more electrochemically active than the second conductive material, and which has a third resistivity at 23° C., and (iii) provides at least part of the electrochemically active surface of the electrode; subject to the proviso that if there are a plurality of outer elements which are partially embedded in and project from the surface of the intermediate element, the outer element comprises a plurality of discrete portions which are spaced apart in non-overlapping relation along the length of the electrode.

Preferred articles of the invention embody both aspects of the invention and comprise an intermediate element composed of a material which has a high resistivity and which is less electrochemically active than the material of the outer element.

In another aspect, the invention provides an electrochemical process in which an electrode of the invention is surrounded by an electrolyte, and current passes between the anode and the electrolyte, particularly a cathodic protection method wherein an electrode of the invention is used as an anode.

BRIEF DESCRIPTION OF THE DRAWING

The invention is illustrated in the accompanying drawing, in which.

DETAILED DESCRIPTION OF THE INVENTION

Figure 1:
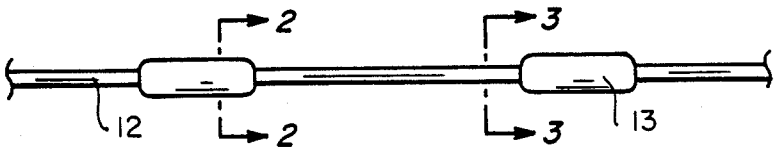
FIG. 1 is a plan view of an electrode of the invention.

The core of the electrodes of the present invention acts as a current distributor and is composed of a material of relatively low resistivity, generally less than $10^{-2}$ ohm.cm. When the electrode is relatively long, e.g. 100 ft. or more, it is preferred that the core be composed of a material of still lower resistivity, e.g. less than $5\times10^{-4}$ ohm.cm, particularly less than $3\times10^{-5}$ ohm.cm, e.g. copper or another metal. The resistivities given herein are measured at 23° C. For shorter lengths, e.g. of less than 60 feet, a carbon fiber or graphite fiber core may be of sufficiently low resistance. The core is usually of constant cross-section along its length. When the electrode is a long one, e.g. of 100 feet or more, or is in the form of an open mesh which is powered from a limited number of contact points, the dimensions of the core are selected so that it has a suitably low resistance, preferably an average resistance of less than $10^{-2}$ ohm/foot, particularly less than $10^{-3}$ ohm/foot, especially less than $10^{-4}$ ohm/foot. The core can be for example a short rod, e.g. of metal, graphite or carbon, 3 to 48 inches long, a long metal wire, solid or stranded, a metal plate, or a mesh structure, e.g. of expanded metal or a net formed by joining metal, graphite or carbon fiber strands together.

The intermediate element electrically surrounds the core, the term "electrically surrounds" being used to mean that when the electrode is immersed in an electrolyte and is in use, all electric current passing between the core and the electrolyte passes through the intermediate element, so that the electrolyte cannot contact and corrode the core. The intermediate element is usually in the form of a coating which is of constant cross-section and which completely surrounds and is in direct physical contact with the core, e.g. a coating of annular cross-section around a core of round cross-section. However, other arrangements are possible. For example, the core can have some sections coated with an insulating polymer and others coated with a conductive polymer. The intermediate element can provide part or none, but not all, of the exposed surface of the electrode (i.e. if the electrode is immersed in a liquid, the outer element is contacted by the liquid, and the intermediate element may or may not be contacted by the liquid). The intermediate element has at least one of the following characteristics:

(1) it has dimensions, and is composed of a material, such that it has a transverse resistance which is sufficiently high to produce a useful improvement in the uniformity of the current distribution, preferably a transverse resistance of at least 1 ohm.meter; and (2) it is composed of a material which is less electrochemically active than the material of the outer member.

In order to determine whether one material is less electrochemically active than another material, the following test should be carried out. A test cell is constructed in which the cathode is graphite or carbon rod, the reference electrode is a a silver/silver chloride electrode, the anode is the material to be tested, and the electrolyte is a 3% by weight solution of sodium chloride in water. The anode is polarized +2.0 volts with reference to the silver/silver chloride electrode, and the current density on the anode is measured after the current has reached a steady state. The anode material which has the lower current density is the less electrochemically active. The current density of the second material is preferably less than 0.2 times, particularly less than 0.1 times, especially less than 0.01 times, the current density of the third material.

The intermediate element preferably has both characteristic (1) and characteristic (2). This can be achieved through the use of a conductive polymer of sufficiently high resistivity as the material of the intermediate element. When the outer element is of low resistivity, e.g. 0.1 to 50 ohm.cm, useful improvements can be obtained by using as the second conductive material (for the intermediate element) a conductive polymer whose resistivity is a few times greater, e.g. at least 2 times greater. However, when long electrodes are to be used, e.g. 100 feet or more, it is preferable for the second conductive material to have a resistivity of at least 1,200 ohm.cm, particularly at least 3,000 ohm.cm, especially at least 8,000 ohm.cm. Such compositions contain lower concentrations of conductive filler than those which have previously been recommended for use in electrodes. The term "conductive polymer" is used herein to denote a composition which contains a polymer component and, dispersed in the polymer component, a particulate conductive filler which has good resistance to corrosion, especially carbon black or graphite or both. The conductive polymer is preferably prepared by melt-shaping, e.g. by pressure extrusion around the core.

However, improved results can be obtained when the intermediate element has only one of characteristics (1) and (2). Thus characteristic (1) above can be achieved through the use of a material for the intermediate element which has high resistivity but which is more electrochemically active than the material of the outer element. In that case, the intermediate element will provide improved current distribution, but will be eroded more rapidly than the outer element if contacted by electrolyte; accordingly, when using such an intermediate element, it preferably does not provide any of the exposed surface of the electrode (i.e. if the electrode is immersed in a liquid, the intermediate element is not contacted by the liquid). Similarly, characteristic (2) above can be achieved through the use of a material for the intermediate element which is highly conductive but which has high resistance to corrosion, e.g. titanium, niobium or platinum. In that case, however, the electrode must be used under circumstances in which less uniform current distribution can be tolerated.

Characteristic (1) above results in an electrode having improved current distribution. The term "transverse resistance" is used to denote the resistance between the inner surface and the outer surface of the intermediate element. The higher the transverse resistance, the better the current distribution, but this must be balanced against other factors such as ease of manufacture, the desired dimensions of the electrode, the desired current off the anode, the available power supplies and the power consumption. In addition, the extent of the improvement in current distribution depends also on the resistance of the electrolyte between the electrode and the substrate to be protected. I have found that the intermediate layer preferably has a resistance of at least 1 ohm.meter, particularly at least 1.5 ohm.meter, especially at least 4 ohm.meter. When using a distributed anode, the use of a high resistance intermediate layer increases the length of the anode which can be employed while keeping the substrate potential within permissible limits. When using a discrete anode comprising a metal core surrounded by an electrochemically active material such as graphite, or a mixture of graphite and carbon, or a dispersion of carbon black or graphite or both in a polymer, e.g. a thermoset resin, the use of a high resistance intermediate layer lengthens the life of the anode by reducing the current density at the point of critical weakness, which is the junction of the metal core and the electrochemically active material.

Characteristic (2) above results in an electrode in which the core is protected from corrosion if the outer member comprises a plurality of spaced-apart portions and/or if the outer member is damaged by physical means or through electrochemical erosion. As indicated above, when, as is preferred, the intermediate element is composed of a conductive polymer, there are concentrations of conductive filler which will provide characteristic (1) as well as characteristic (2). Such concentrations also produce compositions which, by comparison with the conductive polymers containing greater amounts of the filler previously recommended for use in electrodes, have improved physical properties, e.g. tensile strength, elongation and impact resistance, making such compositions all the more satisfactory as a protective layer over the core. The physical properties can be yet further improved by crosslinking, e.g. with the aid of radiation, preferably to a dosage of at least 5 Mrads. The intermediate element provides protection for the core when the outer element is damaged, either by purely physical means or by electrochemical erosion. The latter type of damage is particularly serious when the electrode is used in a situation in which the current density on the surface of the outer element varies substantially over its length, with, in consequence, a similar variation in the rate of ingress. When the damage has reached a point at which electrolyte contacts the intermediate element, through the outer element, the smaller electrochemical activity of the intermediate element causes the electrochemical activity to be transferred to another location.

The outer element of the electrodes of the invention provides at least part and preferably all of the electrochemically active surface of the electrode. In many cases, the outer element will provide the whole of the exposed surface of the electrode (i.e. if the electrode is immersed in a liquid, the liquid does not contact the intermediate layer at all). In such cases, the outer element may be in the form of a coating which is of constant cross-section and which completely surrounds a single intermediate element and is in direct physical contact with the intermediate element, e.g. a coating of annular cross-section around a single intermediate element, or in the form of a tape with two or more parallel intermediate elements embedded therein. Such an outer element is preferably prepared by melt-shaping, e.g. by pressure extrusion of a conductive polymer around the intermediate element or elements.

In other cases, the outer element provides only part of the exposed surface of the electrode. For example, in one embodiment, the electrode comprises a tape or other elongate element which is composed of a conductive polymer and which provides the outer element, and at least one conductive-polymer-coated metal wire which is partially embedded in the tape and which provides the core and the intermediate element. Such an electrode is preferably used so that the electrolyte contacts only the face of the tape which does not have the conductive-polymer-coated wire embedded in it, so that, even though the outer element does not provide the whole of the exposed surface of the electrode as defined above, it does in use provide all of the electrochemically active surface of the electrode. In another embodiment, the outer element comprises a plurality of discrete portions which are spaced apart along the article. This is particularly useful when it is desired to make an elongate flexible electrode in which at least part of the electrochemically active surface is provided by a material which is not flexible (e.g. a thermoset or other polymer containing a high loading of carbon black or graphite). In such cases, the core and the intermediate element can be made from materials such that the parts of the electrode between the discrete portions of the outer element are sufficiently flexible to enable the electrode to be easily stored and transported as a roll.

In preferred embodiments of the present invention, at least one of the second and third conductive materials (for the intermediate and outer elements respectively) is a conductive polymer, preferably a melt-extruded conductive polymer having an elongation of at least 10%, particularly at least 25%. The outer layer is preferably at least 500 microns thick, particularly at least 1,000 microns thick. When the intermediate layer is not contacted by electrolyte (unless and until physical damage to or electrochemical erosion of the outer element exposes the intermediate layer), it is preferably at least 200 microns thick, particularly at least 350 microns thick, e.g. 350 to 1,500 microns thick. When the intermediate layer is contacted by electrolyte when the electrode is first used, similar thicknesses can be used, but somewhat greater thicknesses are preferred, e.g. at least 500 microns, particularly at least 1,000 microns. When the third conductive material is a conductive polymer, it preferably has a third resistivity of 0.01 to 300 ohm.cm, particularly 0.1 to 50 ohm.cm. The second conductive material preferably has a second resistivity which is at least 2 times, particularly at least 10 times, especially at least 100 times, the third resistivity, and/or which is at least 500 ohm.cm above, particularly at least 1,200 ohm.cm above, especially at least 5,000 ohm.cm above, the third resistivity.

When one or both of the second and third conductive materials is a conductive polymer, the conductive filler is preferably carbon black and/or graphite. When both are conductive polymers, the fillers can be the same or different, and useful advantages may result from the use of different fillers which are selected with a view to the different functions of the intermediate and outer elements. For good properties in the intermediate layer, carbon blacks having high structure (e.g. a DBP value of 80 or more) have the advantage that they can impart satisfactory conductivity at relatively low loading. Tests have shown that the electrochemical activity of these carbon blacks falls rapidly in use, which is a positive advantage in the intermediate layer.

The interface between the intermediate and outer elements is preferably free from portions which are reentrant into the intermediate element, particularly a smooth regular surface such as is obtained for example by melt-extruding or molding the outer element(s) around a melt-extruded or molded intermediate element.

A particularly useful embodiment of the present invention is an electrode which can be secured to a mass of concrete containing metal reinforcing bars and which can then be used as an anode in the cathodic protection of those reinforcing bars, and which comprises (1) an elongate tape which is composed of a first conductive polymer, and (2) an elongate filamentous member which is at least partially embedded in the tape and which comprises (a) a continuous elongate metal core, and (b) an elongate intermediate element which electrically surrounds the core and which is composed of a second conductive polymer having a resistivity at 23° C. which is at least 2 times, preferably at least 5 times, particularly at least 10 times, the resistivity at 23° C. of the first conductive polymer.

The electrode preferably is associated with a carrier which is composed of an insulating material and which can be secured to a surface of the concrete containing the reinforcing bars, for example a carrier in the form of a shallow trough with laterally extending side members which comprise apertures or other means for securing the carrier to a concrete surface. The elongate tape is placed in the shallow trough of the carrier, preferably with the filamentous member adjacent the carrier, and the side members are attached to the concrete, e.g. to the horizontal underside or a vertical surface of the concrete, by means of fasteners secured to the carrier, e.g. through apertures in the side members, or by means of adhesive. Preferably a layer of a deformable ionically conductive material is placed between the tape and the concrete. This layer is preferably composed of a polymer (e.g. a polar elastomer such as an ethylene oxide/-halohydrin copolymer) containing a humectant (e.g. a hydroxyalkyl or carboxy alkyl cellulose) and an ionic salt (e.g. calcium hydroxide or calcium nitrite) and optionally a plasticizer for better conformity to the concrete. This layer can if desired comprise reinforcement, for example fibers (preferably cellulosic or other hydrophilic fibers), which can be randomly distributed or in the form of a mesh. An elastically compressible member may be placed between the tape and the carrier so that, when the carrier is secured to a concrete surface, the compressible member is compressed and urges the tape towards the concrete surface. This layer can for example be composed of a foamed elastomer. Alternatively or additionally the carrier can be shaped so as to maintain pressure on the anode when it is in place.

The electrodes of the present invention can be composite articles which comprise two (or more) cores, each electrically surrounded by an intermediate element, and a single outer element in which the intermediate elements are fully or partially embedded. In use of such composite articles, both (or all) of the cores can be connected to the power supply and used as an electrode, or only one (or some) of the cores can be used as an electrode, with the other(s) being left for future use when the initially used electrode(s) has (or have) become inoperable. The electrodes of the invention can also comprise one or more insulated conductors for use as part of a monitoring or fault-finding system, or to feed power to other electrodes or to the far end of the core or cores of the same electrode.

Figure 2:
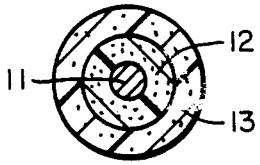
FIGS. 2 and 3 are cross-sectional views of the electrode of FIG. 1.
Figure 3:
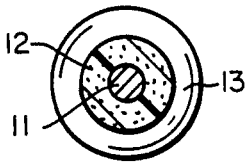

Referring now to the drawing, FIG. 1 is a plan view, and FIGS. 2 and 3 are cross-sectional views on 2-2 and 3-3 of FIG. 1, of a distributed electrode of the invention which comprises a metal core 11; a continuous intermediate element 12 which surrounds the core 11 and is composed of a conductive polymer having a relatively high resistivity, e.g. about 500 ohm.cm or more; and discrete outer elements 13 which are spaced apart along the length of the electrode and which are composed of a conductive polymer having a relatively low resistivity, e.g. less than 300 ohm.cm, particularly less than 50 ohm.cm.

FIG. 2 is also the cross-sectional view of another distributed electrode of the invention, not illustrated in plan view, which has a constant cross-section along its length.

Figure 4:
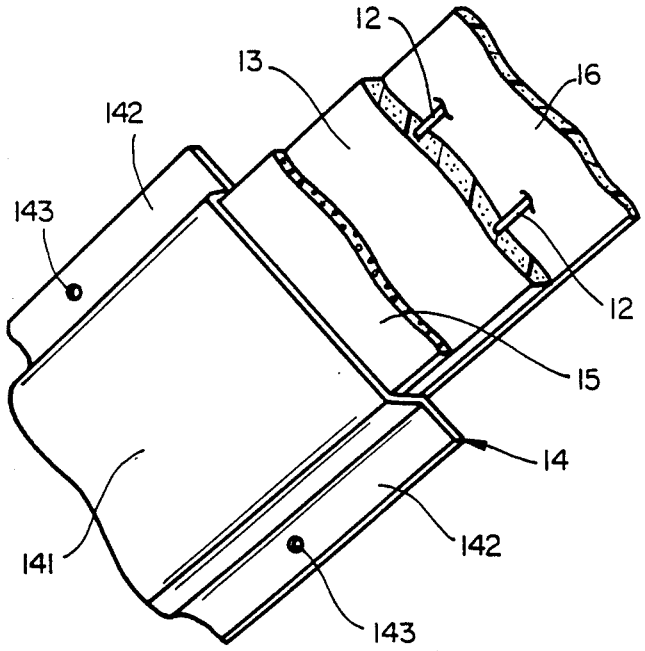
FIG. 4 is a perspective view of another electrode of the invention.
Figure 5:
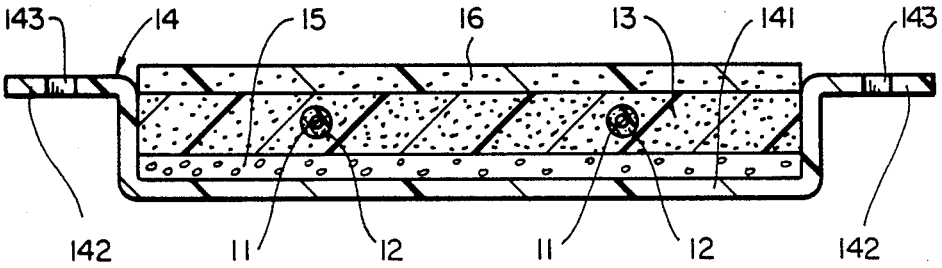
FIG. 5 is a cross-sectional view of the electrode of FIG. 4.

FIG. 4 is a perspective view, and FIG. 5 is a cross-sectional view, of another distributed electrode of the invention which comprises a tape 13 of a conductive polymer having a relatively low resistivity; two conductive-polymer-coated wires each of which comprises a metal core 11 and a continuous coating 12 of a conductive polymer having a relatively high resistivity and each of which is embedded in the tape 13; a carrier 14 which is composed of an insulating polymer and which comprises a shallow trough portion 141 and laterally extending side members 142 having apertures 143 therein; an elastically compressible insulating member 14, e.g. a foamed polymer, which lies between the trough portion 141 and the tape 13; and a member 16 which is composed of a deformable, conductive material which covers the surface of the tape 13 which is remote from the carrier. The conductive material is preferably ionically conductive, but can be electronically conductive. The article shown in FIGS. 4 and 5 can be secured to a mass of concrete by means of fastening devices which pass through the apertures 143, thus compressing the member 15 and deforming the member 16 so that good electrical contact is produced and maintained between the concrete and the conductive polymer element 13.

Figure 6:
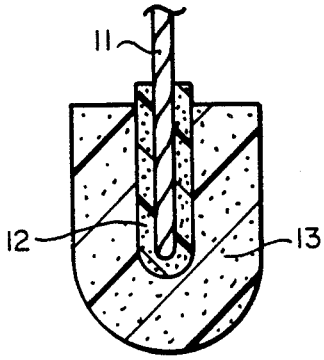
FIG. 6 is a cross-sectional view of another electrode of the invention.

FIG. 6 is a cross-sectional view of a discrete electrode of the invention which comprises a metal core 11; an intermediate element 12 which surrounds the core 11 and is composed of a conductive polymer having a relatively high resistivity; and an outer element 13 which is composed of a mixture of a graphite and carbon having a relatively low resistivity.

The invention is illustrated by the following Examples.

EXAMPLES 1 AND 2

Electrodes were produced by melt-extruding a first annular layer of one of the conductive polymer compositions shown in Table 1 around a nickel-coated copper stranded wire and then a second annular layer of another of the compositions shown in Table 1 around the previously-coated wire. Table 1 also shows the extruded resistivity of the compositions. Table 2 below shows the size of the wire, the composition or compositions employed, and the outer diameter of each layer.

The ingredients shown in Table 1 are further identified below.

Kynar 460 is polyvinylidene fluoride available from Pennwalt Chemical Co.

Solef 1010 is polyvinylidene fluoride available from Solvay.

Hycar 4041 is an acrylic elastomer available from B.F. Goodrich.

Viton A35 is a fluoroelastomer available from duPont (Canada).

Sclair 11W is a linear low density polethylene available from Gulf.

Shawinigan Black is carbon black available from Shawinigan Chemical and having a particle size of about 42 millimicrons and a surface area of about 64 $m^2/g$.

Raven 8000 is carbon black available from Cities Services Co., Columbian Division, and having a particle size of about 13 millimicrons and a surface area of about 935 $m^2/g$.

Statex G is carbon black available from Cities Services Co., Columbian Division, and having a particle size of about 60 millimicrons and a surface area of about 32 $m^2/g$.

Statex 160 is carbon black available from City Services Co., Columbian Division, and having a particle size of about 19 millimicrons and a surface area of about 150 $m^2/g$.

EXAMPLE 3

An anode as shown in FIGS. 4 and 5 was made as follows.

Composition F of Table 1 was melt-extruded around a 22 AWG nickel-coated copper stranded wire to give a product having an outer diameter of about 0.055 inch. The coated wire was irradiated to a dose of about 15 Mrad to cross-link the conductive polymer thereon.

Composition E of Table I was melt-extruded around two lengths of the coated and irradiated wire, about 1.5 inch apart, using a cross-head die, to give a strip of Composition E about 3 inch wide and about 0.085 inch thick, with the coated wires embedded therein.

The ionically conductive member is a strip about 3 inch wide and 0.07 inch thick of a plasticized ethylene oxide/epichlorohydrin copolymer (available as Hydrin 200 from B. F. Goodrich) which has been impregnated with Cellosize H & C, which is a hydroxyethyl cellulose available from Union Carbide, and calcium nitrite.

The carrier member is composed of a highly coupled, mica-filled polypropylene available from Washington-Penn P.

The compressible member is composed of a compression-set-resistant polyethylene foam available from Wilshire Foam.

TABLE 1

| | Composition | | | | | |
|---|---|---|---|---|---|---|
| Ingredients | A | B | C | D | E | F |
| Polymer | | | | | | |
| Kynar 460 | 85.2 | | | | | |
| Solef 1010 | — | 36.5 | | | | |
| Hycar 4041 | — | 24.4 | | | | |
| Viton A35 | 5.1 | | | | | |
| Sclair 11W | — | — | 42.8 | 64.8 | 45.5 | 62.0 |
| Stabilizers | 3.6 | 7.1 | 7.2 | 7.2 | 9.5 | 9.5 |
| Carbon Black | | | | | | |
| Shawinigan Black | — | 32 | — | — | 45 | 28.5 |
| Raven 8000 | 6.1 | — | — | — | | |
| Statex G | — | — | 50 | — | | |
| Statex 160 | — | — | — | 28 | | |
| Resistivity (ohm.cm) | 2000 | 2.1 | 1.5 | 300 | 2 | 125 |

TABLE 2

| | 1 | 2 |
|---|---|---|
| Wire (AWG) | 20 | 16 |
| Inner Layer | | |
| Composition | A | D |
| O.D. (inch) | 0.1 | 0.1 |
| Outer layer | | |
| Composition | B | C |
| O.D. (inch) | 0.235 | 0.314 |

We claim:

1. An elongate article which is suitable for use as a distributed electrode in an electrochemical process and which comprises (a) an elongate core which (i) is composed of a first conductive material having a first resistivity at 23°C., and (ii) does not provide any part of the electrochemically active surface of the electrode;

(b) an elongate intermediate element which (i) is secured to and electrically surrounds the core, (ii) is composed of a second conductive material which is a conductive polymer and which has a second resistivity at 23° C., the second resistivity being at least 1200 ohm.cm and being higher than the first resistivity, (iii) does not provide any part of the electrochemically active surface of the electrode, and (iv) has a transverse resistance of at least 1 ohm.meter; and (c) at least one outer element which (i) is secured to and is in electrical contact with the core and the intermediate element so that all electrical paths between the core and the outer element pass through the intermediate element, (ii) is composed of a third conductive material which is a conductive polymer and which has a third resistivity of 23° C., the third resistivity being 0.01 to 300 ohm.cm, and (iii) provides at least part of the electrochemically active surface of the electrode.

2. An article according to claim 1 wherein the first conductive material is a metal.

3. An article according to claim 1 wherein the first conductive material is a metal, the second conductive material in a conductive polymer having a resistivity at 23° C. of at least 1200 ohm.cm and the third conductive material is a conductive polymer having a resistivity at 23° C. of 0.1 to 50 ohm.cm.

4. An article according to claim 1 wherein the second resistivity is at least 100 times the third resistivity and at least 10,000 times the first resistivity.

5. An article according to claim 1 wherein the second material has a current density at 2 volts in 3% sodium chloride solution which is less than 0.1 times the current density of the third material at 2 volts in 3% sodium chloride solution.

6. An elongate article which is suitable for use as a distributed electrode in an electrochemical process and which comprises (a) an elongate core which (i) is composed of a metal having a first resistivity at 23° C., and (ii) does not provide any part of the electrochemically active surface of the electrode;

(b) an elongate intermediate element which (i) is secured to and electrically surrounds the core, (ii) is composed of a second conductive material which is a conductive polymer and which has a second resistivity at 23° C., the second resistivity being higher than the first resistivity, (iii) does not provide any part of the electrochemically active surface of the electrode, and (iv) has a transverse resistance of at least 1 ohm.meter; and (c) at least one outer element which (i) is secured to and is in electrical contact with the core and the intermediate element so that all electrical paths between the core and the outer element pass through the intermediate element, (ii) is composed of a third conductive material which is selected from graphite, mixtures of graphite and carbon, and dispersions of carbonaceous materials in thermoset resins, and (iii) provides at least part of the electrochemically active surface of the electrode.

7. An elongate article which is suitable for use as a distributed electrode in an electrochemical process and which comprises (a) an elongate core which is composed of a first conductive material having a first resistivity at 23° C. and which does not provide any part of the electrochemically active surface of the electrode;

(b) an elongate intermediate element which (i) is secured to and electrically surrounds the core, (ii) is composed of a second conductive material having a second resistivity at 23° C., and (iii) does not provide any part of the electrochemically active surface of the electrode; and (c) at least one outer element which (i) is secured to and is in electrical contact with the core and the intermediate element so that all electrical paths between the core and the outer element pass through the intermediate element, (ii) is composed of a third conductive material which is more electrochemically active than the second conductive material, and which has a third resistivity at 23° C., and (iii) provides at least part of the electrochemically active surface of the electrode.

8. An article according to claim 2 wherein the first resistivity is less than the second resistivity and less than the third resistivity.

9. An article according to claim 7 wherein the third material is a conductive polymer and the second material is a conductive polymer having a resistivity of at least 25 ohm.cm.

10. An article according to claim 7 wherein the third material is a conductive polymer and the second material is a metal.

11. An elongate article which is suitable for use as a distributed anode in the cathodic protection of reinforcing bars embedded in concrete, and which comprises (1) a continuous elongate tape which is composed of a first conductive polymer having an elongation of at least 10% and a resistivity at 23° C. of 0.01 to $10^3$ ohm.cm; and (2) a continuous elongate filamentous member which is at least partially embedded in the tape and which comprises (a) a continuous elongate metal core which has a resistance at 23° C. of less than 0.03 ohm/meter; and (b) a continuous elongate intermediate element which electrically surrounds the core and which is composed of a second conductive polymer having an elongation of at least 10% and a resistivity at 23° C. which is at least 2 times the resistivity at 23° C. of the first conductive polymer.

12. An article according to claim 11 which further comprises a carrier which is composed of an insulating material and which can be secured to a surface of a mass of concrete.

13. An article according to claim 12 wherein the carrier is in the form of a shallow trough with laterally extending side members comprising means for securing the carrier to a concrete surface.

14. An article according to claim 13 which comprises an elastically compressible member which lies between the elongate tape and the carrier and is such that when the carrier is secured to a concrete surface, the compressible member is compressed and urges the tape towards the concrete surface.

15. An article according to claim 12 which comprises a layer of a deformable electrically conductive material on the major surface of the tape which, when the carrier is secured to a surface of a mass of concrete, is nearer the concrete.

16. An article according to claim 11 wherein the first conductive polymer has a resistivity of 0.1 to 100 ohm.cm and the second conductive polymer has a resistivity which is at least 50 ohm.cm and at least 50 ohm.cm higher than the resistivity of the first conductive polymer.

* * * * *

UNITED STATES PATENT AND TRADEMARK OFFICE

CERTIFICATE OF CORRECTION

PATENT NO. : 4,957,612

DATED : September 18, 1990

INVENTOR(S) : Stewart et al.

It is certified that error appears in the above-identified patent and that said Letters Patent is hereby corrected as shown below:

Column 12, claim 8, line 13, replace "claim 2" by --claim 7--.

Signed and Sealed this

Sixth Day of July, 1993

*Attest:*

Michael K. Kirk

MICHAEL K. KIRK

*Attesting Officer*

*Acting Commissioner of Patents and Trademarks*